United States Patent [19]

Boivin

[11] 4,226,707

[45] Oct. 7, 1980

[54] CENTRIFUGAL CLEANER

[75] Inventor: Joseph R. G. Boivin, Grand 'Mere, Canada

[73] Assignee: Consolidated-Bathurst Limited, Montreal, Canada

[21] Appl. No.: 914,034

[22] Filed: Jun. 9, 1978

[51] Int. Cl.[2] ..... B04C 5/14

[52] U.S. Cl. ..... 209/211; 55/435; 233/46

[58] Field of Search ..... 209/144, 211; 210/512; 55/435; 241/79.1; 51/129; 125/30; 233/20 R, 46

[56] References Cited

U.S. PATENT DOCUMENTS

| | | | |
|---|---|---|---|
| 3,136,723 | 6/1964 | Erwin et al. | 210/512 R |
| 3,237,777 | 3/1966 | Brown et al. | 55/435 |
| 3,277,926 | 10/1966 | Skandal | 209/211 |
| 3,419,152 | 12/1968 | Ramond | 210/512 R |
| 3,499,531 | 3/1970 | Feasel | 210/512 R |

*Primary Examiner*—William A. Cuchlinski, Jr.
*Attorney, Agent, or Firm*—Romney, Schaap, Golant, Disner and Ashen

[57] ABSTRACT

The invention provides improvements in vortex separators for separating the rejects from the accepts in a particle-laden fluid, the separator including, in preferred embodiments, a replaceable inner wall lining minimizing maintenance costs while raising separating efficiency, and in addition, includes means for submitting the rejects to a size reduction process, an elutriation process, a dilution process, and a throttling process, all in one compact unit.

14 Claims, 5 Drawing Figures

CENTRIFUGAL CLEANER

The present invention relates to improvements in separators and more particularly, relates to improvements in methods and apparatuses for separating certain particles from other particles in a particle-containing fluid.

Apparatuses are known in the art for separating certain particles from other particles—such apparatuses are known as, for example, centrifugal cleaners, vortex separators, and the like. Generally, the particles to be separated are undesirable and often oversized and/or relatively heavy compared to the more desirable particles. Usually, the particles to be removed constitute a relatively small proportion of the overall weight of particles present in the particle-containing fluid.

As aforementioned, apparatuses such as vortex separators employed in the prior art for the treatment of the particle-containing fluid are well known and generally, the particle-containing fluid is introduced into a chamber in the form of a high velocity vortex, the main part of the fluid containing the desirable particles being withdrawn from one end of the chamber and the remaining part of the fluid containing the undesirable particles being withdrawn from the other end of the chamber. The apparatuses receive wide use, for example, in the cleaning of paper pulp stock and various mineral mixtures.

One problem encountered with the prior art cleaners is the erosion of the inner wall lining by the particle-laden fluid which results in high maintenance costs and lower separating efficiency. While certain cleaners are equipped with linings which can be machined out and replaced, the attendant costs have discouraged their use.

In addition, in prior art vortex separators which use an elutriation process, a lower plate is normally lowered a substantial amount so that a reject end of the separator is open to the elutriation chamber.

It is an object of the present invention to provide improvements in a method and apparatus for cleaning a particle-carrying fluid and for separating a particular class of particles therefrom.

In a preferred embodiment of the present invention, there is provided an apparatus for separating undesired particles from liquids and liquid suspensions, the apparatus comprising a chamber having a side wall disposed concentrically about a longitudinal axis, an inlet adjacent one end of said chamber, a first discharge outlet in an end wall adjacent said first end, and a restricted outlet at the other end of said chamber, an inlet adjacent said first end for introducing a particle-laden fluid into said chamber and imparting a vortical flow thereto, lining means to protect from erosion the inner surface of said chamber, and a reject control and closure means concentric with and into which the restricted outlet at the other end of said chamber opens, the entrance to said enclosure being formed by an annular slit-like passage for discharge of rejected material, an annular enclosure surrounding said slit, the internal bottom surface of said enclosure being formed by a relatively blunt upright conical abrasive surface having an inverted conical area therein, the height of said slit-like passage being defined by the extension of said restricted lower end towards said surface such that the size of rejected material passing through said slit is controlled and the material held at the opening of said passage, while orbiting around said opening, is worn by said abrasive surface to a size which will allow the same to pass through said slit.

In a further embodiment of the present invention there is provided, in an apparatus for separating undesired particles from liquids and liquid suspensions wherein the apparatus includes a chamber having a side wall disposed concentrically about a longitudinal axis, an inlet adjacent one end of said chamber, a first discharge outlet in an end wall adjacent said first end, and a restricted outlet at the other end of said chamber, an inlet adjacent said first end for introducing a particle-laden fluid into said chamber and imparting a vortical flow thereto, the improvement comprising separate removable lining means interiorly of and adjacent to said side wall to protect from erosion the inner surface of said chamber, said lining means having a configuration substantially similar to that of the chamber, whereby said lining means is adapted to fit into juxtaposition with said side wall of said chamber.

In a still further preferred embodiment of the present invention there is provided an apparatus for separating undesired particles from liquids and liquid suspensions, the apparatus comprising a side wall disposed concentrically about a longitudinal axis, an inlet adjacent one end of said chamber, a first discharge outlet in an end wall adjacent said first end, a restricted outlet at the other end of said chamber, an inlet adjacent said first end for receiving a particle-laden fluid and imparting a vortical flow thereto, a reject control and closure means concentric with and into which the restricted outlet at the other end of said chamber opens, the entrance to said enclosure being formed by an annular slit-like passage for discharge of rejected material, an annular enclosure surrounding said slit, the internal bottom surface of said enclosure being formed by a relatively blunt upright conical abrasive surface having an inverted conical area therein, the height of said slit-like passage being defined by the extension of said restricted lower end towards said surface such that the size of rejected material passing through said slit is controlled and the material held at the opening of said passage, while orbiting around said opening, is worn by said abrasive surface to a size which will allow the same to pass through said slit, and centrifugal throttling means at the lower outlet to reduce the fluid pressure of the rejected fluid, said throttling means being adapted to receive an inlet flow whose direction is parallel to the longitudinal axis of the chamber.

Having thus generally described the invention, reference will be made to the accompanying drawings illustrating embodiments thereof, in which.

Figure 1:
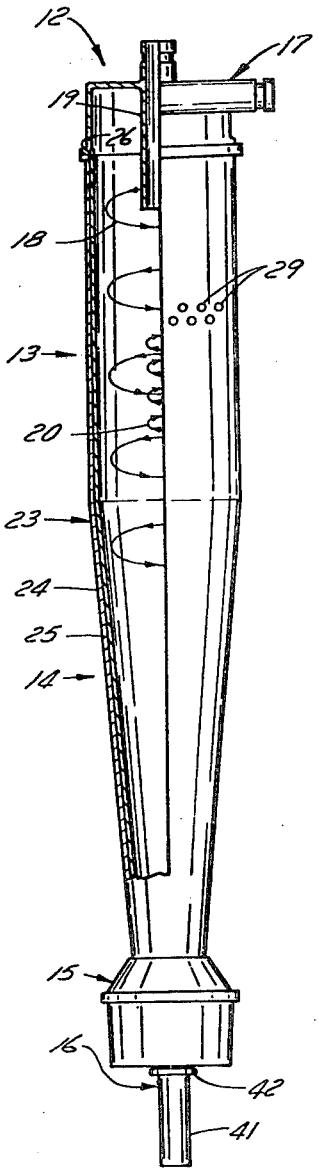
FIG. 1 is a side elevational view, partially in section, of an embodiment of a centrifugal cleaner incorporating the improvements of the present invention.
Figure 3:
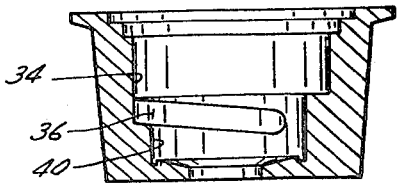
FIG. 3 is a side sectional view of a component of the cleaner.
Figure 2:
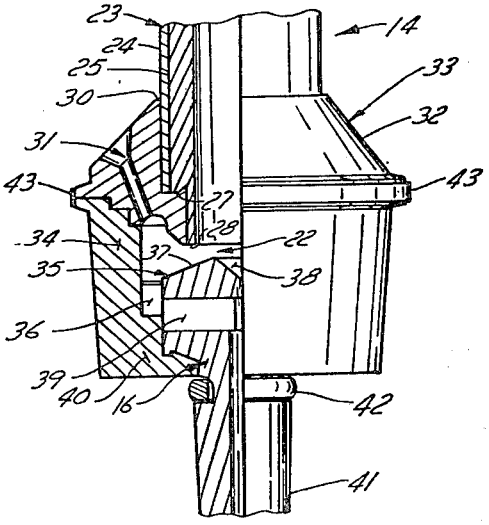
FIG. 2 is a side elevational view, partially in section, of a portion of the cleaner of FIG. 1.
Figure 5:
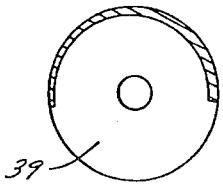
FIG. 5 is a cross-sectional view taken along the lines 5—5 of FIG. 4.
Figure 4:
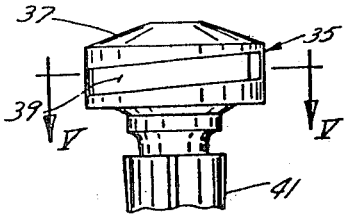
FIG. 4 is a side elevational view of a portion of the nozzle.

Referring to FIG. 1, the device as shown comprises a headpiece 12, an upper barrel portion 13, a lower conical portion 14, a reject-elutriator 15, and a reject-centrifugal nozzle 16.

The headpiece 12 has a stock inlet portion 17 designed to restrict a fluid entering under pressure so as to convert a considerable part of the pressure energy into velocity energy, thereby causing a high velocity vortex indicated by arrows 18 to occur in barrel portion 13 and to travel down into conical portion 14. Inwardly of the headpiece is a cylindrical partition portion 19, often referred to as a vortex finder, which also serves as the central outlet discharge for the cleaned accepted stock (termed "accepts").

During the travel of the liquid of the vortex 18 downwardly, the larger and heavier particles therein, including those with a low surface area to weight ratio, are thrown or moved outwardly to the wall of the barrel under the centrifugal and shear forces induced by the vortex, and then travel downwardly to the bottom of conical portion 14. Also in lower conical portion 14, the more central portions of the vortex, which contain the cleaner, smaller, lighter and relatively high surface to weight ratio particles, are reversed in direction and are turned upwardly to form an upwardly extending inner vortex as indicated by arrows 20, this inner vortex being of a diameter at least sufficient to fill the outlet opening of portion 19; the velocity of the above vortices will generally be such that a low pressure gas cone will be formed axially of the device. Such a gas cone will ordinarily extend upwardly into the outlet portion 19 and at its lower end the cone will ordinarily extend down to the bottom of the rejects-elutriator 15. Thus, the larger and heavier particles (termed "rejects") are thrown onto the wall of the barrel 13 and cone 14 and slide down over the internal surface of these portions until they reach 22, the rejects outlet from the cone and/or the reject inlet to the rejects-elutriator 15, and which consists of an annular slit-like passage designated by reference numeral 15 and which will be described below in greater detail.

The design geometry of the barrel and cone portions are well known in the art. Heretofore, however, previous material and component-part design of these portions has failed to substantially reduce the high maintenance cost and/or the loss of cleaning efficiency arising from the erosion of the internal surfaces of barrel 13 and conical portion or cone 14 as the particles, mentioned above, slide downwardly against these surfaces. This is particularly true for applications where very abrasive particles are included in the heavier particles thrown against and sliding on these internal surfaces. In some of the previous attempts the barrel and more generally the cone have been made of erosion-resistant materials, particularly ceramic materials such as carborundum and alundum. These materials, however, are very expensive and subject to breakage. Even when less expensive materials were used, such as nylon and steel, there was a tendency to keep these still expensive parts in use until they failed structurally; in the meantime, however, the eroded internal surfaces were contributing to a lowering of the cleaning efficiency of the centrifugal device due to a turbulence caused by the roughened surfaces.

According to one embodiment of the invention, the internal surfaces of the barrel and/or cone portions can be kept relatively smooth inexpensively. A detailed application of such a structure in the present invention can be described as follows.

Referring to FIG. 1, barrel 13 and cone 14 portions are combined to form a barrel-cone section generally designated by reference numeral 23 which in turn consists of two parts, an outer barrel-cone shell 24 and an inner barrel-cone replaceable lining or sleeve 25.

The sleeve is made of an isocyanate resin such as polyurethane rubber, hereinafter referred to as urethane. Urethane is particularly suitable as an abrasive liner and may be used as a relatively thin sleeve since it is relatively inexpensive and can be changed or replaced as frequently as is necessary to maintain high cleaning efficiency. A hardness range for the urethane of about 75 A to about 75 D Durometer has been found to yield good results. A thickness range for the lining or sleeve wall of about one-quarter of an inch to three-quarters of an inch will cover most applications; for a relatively small diameter barrel, e.g. 4–6 inches, a thickness of $\frac{5}{8}$ inch is adequate. To prevent the urethane from moving or extruding at the end of the sleeve, the sleeve is recessed at both ends as identified by reference numerals 26 and 27 so it will mate more securely with the other more rigid parts of the unit and, when necessary, these sections may be reinforced with steel embedded in the plastic to prevent distortion. Various parts of the sleeve can be varied in thickness to conform to the various cleaner sizes and allow use of universal parts for these varied sizes; this is particularly true at the lower end towards the rejects outlet cone tip 28 where a universal reject unit is used. Other types of rubber (e.g. natural rubber) and resin (e.g. nylon) can also be used for replaceable sleeve 25.

The barrel-cone shell 24 is sufficiently perforated to allow any liquid/gas to escape which might form or accumulate at the interface between the lining and the shell. The perforations are indicated at 29. When urethane linings are used with a solid shell 24, liquid accumulates at this interface (probably due to osmotic action) in sufficient quantities to cause the lining to separate from the shell and to cause blisters. The extent of this phenomenon varies with the type of urethane. The extent of the perforation will vary not only with the type of urethane but also with the degree of bonding present at the interface. Loose bonding, as would be the case here for a replacement sleeve, would require fewer perforations in the shell as the liquid could travel along the interface and exit from the nearest perforation or aperture. The upper perforation limit depends essentially on structural strength and cost. Generally, one to four $\frac{1}{8}$th inch diameter holes per square foot have been found adequate. Since the shell provides the main structural strength it can be made out of any of the conventional structural materials. Fiberglass has been found to be a relatively inexpensive and suitable material; perforated steel plate and mesh has also been used. If the material used for the lining or sleeve is not susceptible to the above blistering phenomenon, the perforations have been found useful for separating the lining from the shell when the sleeve has to be replaced. To that extent, perforations greater than $\frac{1}{8}$ inch diameter may be desirable so that larger, less pointed, devices can be inserted in the perforations when so used to push and separate the lining from the shell; alternatively, fluid pressure could be applied through these holes.

While the conical piece of the main cleaner may have straight sides or at least straight vertical elements for the greater part of the cone, a preferred embodiment employs a cone where vertical elements curve inwardly, that is, towards the lower portions of the cone, the walls slant more and more directly downward than at the upper portions.

The barrel and cone sections may also consist of separate parts (i.e. an outer shell barrel and outer shell cone and their separate inner sleeves) joined together by a clamp or flange and the replaceable sleeves too may consist of separate parts. This is of importance mainly when repairing prior art cleaners or adapting them to the various features of this invention.

The universal reject-elutriator for this particular embodiment consists of the following sections/aspects:

(a) a universal flange assembly, which consists of an end grip portion 30 which presses or is pressed against the lower part of the shell, an elutriating liquid inlet 31 and a sealing ring or collar 32, held by 30 or bonded directly to or screwed into shell 24; these portions may be separate parts or molded in one part as shown (and referred to as 33) using conventional structural materials, urethane being a preferred material;

(b) a universal reject-elutriator body or annular enclosure 34 made preferably of urethane of about 70–80 D and which contains the rest of the elutriating liquid tangential inlet plus a special chamber recessed in the upper part of the main chamber for blending the elutriating and chamber liquids; alternatively, the elutriating inlet may connect directly with the above-mentioned special chamber;

(c) a universal dimple or core plate 35, which serves as the bottom of the chamber and also forms a part of the one tangential outlet 36 for the rejects and which forms a centrifugal throttling means; (the plate at the same time serves as the top of the reject centrifugal nozzle and the top of the tangential outlet 36 to the reject-centrifugal nozzle 16). The central part of plate 35 consists of an outer relatively blunt upright cone 37 against which the vortical liquid impinges and an inner, and a more fully central small inverted conical portion 38 which serves to centre the vortex 20 and gas core. The inner and outer conical portions may be all one piece or in separate pieces; they also may be of separate materials or of the same material (e.g. urethane); the inner part, for example, may be made of ceramic. The nature of the material is important in situations where the abrasive property of the material can be used to good advantage to reduce the size of the reject material as it orbits in this gap. The plate also defines or sets gap 22 through which the reject and elutriating flows must pass. The width of this gap may be changed by removing a portion of tip 28 or extending it and/or adding or removing material spacers from the top side of recess 27.

It will be noted that both the reject flow from the main cleaner section and the back-flow of the elutriating liquid into the main cleaner section is controlled by the gap or annular slot 22 between the tip 28 of the conical sleeve and the surface of the dimple plate 35. Prior art designs use this gap only for the flow of the rejects and whenever elutriation is added the dimple plate is lowered 3–12 inches so that the whole area of the reject end of the conical portion 14 is open to the elutriation chamber. This latter method of elutriation was not used because it was felt that elutriation would not work in a restricted area and/or with a restricted inflow/backflow to the conical section. Applicant, on the other hand, has found after much experimentation that this is not so and in addition to yielding a very compact elutriation chamber, the method and device allows for a better distribution of elutriating liquid between the backflow and the reject flow out of the chamber; in particular, the rejects have a lesser tendency to thicken and to block the outlets from the chamber, similarly less dilution of the backflow takes place with the result that the accepts leaving through outlet 19 have a higher consistency. Lower rejects consistency and higher accepts consistency are both highly desirable objectives. Further, this compact, relatively inexpensive design makes it possible to provide every cleaner with adjustable elutriation and reject dilution all in the same device.

As shown in the drawings, the elutriating liquid enters tangentially and is combined with the liquid (in the elutriator) in a special recessed or arched section in the upper part of the elutriator chamber. By blending the elutriating liquid with chamber liquid in a separate area, the turbulent mixing of the two liquids is minimized thereby preserving the elutriating effect. However, as mentioned in certain situations, the tangential aspect may be eliminated and the connection may be made directly to this arched section.

In prior art methods involving the use of a core-trap or plate, the reject flow leaves the chamber through one outlet in a direction which is at right angles to the central axis of the chamber. Applicant, on the other hand, has found that it is possible and advantageous for the reject flow to leave the chamber through the outlet in a direction which is parallel to the central axis of the chamber. The axial direction allows for a more overall compact design. The tangential outlet or ramp 36 also serves as tangential inlet or ramp to the reject-centrifugal nozzle 16 described below. The size of the single inlet to the nozzle can be varied by an adjustable orifice to allow for an adjustment in the rate of flow. With this more compact elutriator it is important not to use too high a flow of elutriating liquid as at high inlet flows, turbulence is created which destroys the elutriating action. One method of adjusting this flow is to begin with no flow and then to increase it gradually until an examination shows (a) the rejects fraction in the accepts is acceptable or has not increased unduly and (b) the accepts fraction in the rejects is at a minimum. A typical acceptable flow is in the order of one gallon per minute. The above reject-elutriator embodiment is hereinafter referred to as the "low-flow reject elutriator."

For situations where a higher degree of elutriation (at higher flows) is desired, the reject-elutriator may be modified as hereinafter described and as such it is referred to as the "high-flow reject elutriator."

Applicant's reject centrifugal nozzle 16 consists of the following sections:

(a) a universal reject-centrifugal nozzle body preferably made of urethane of about 70–80 D reinforced with steel. In the preferred embodiment, a top plate 35, described above under (c), in conjunction with the reject-elutriation chamber 15, where it serves as the bottom to that chamber, also serves as the roof of the inner nozzle. Part of the outer wall of the nozzle 16 contains an opening 39 into which the above-mentioned ramp spills; for ease of manufacture and reduced cost, the outer walls and floor of the ramp are contained in the lower part or cage 40 of outer body 34 and the outer surface of the nozzle serves as the inner wall for the ramp or channel leading up to opening 39. Thus, the inner chamber of the nozzle is contained by the bottom surface of plate 35 and a floor which is spaced from this surface by, for example, approximately ¾" with walls extending approximately ½ to ⅝ around the circumference of the chamber and the rest of the circumference consisting of opening 39. Nozzle body 16 is circular and can rotate within cage 40; in the center of the floor of the nozzle chamber is an opening through which the rejects leave to enter tube 41 which carries the reject flow away from the body of the overall enclosure. Tube 41 could, if desired, be connected to a common closed reject header or to a separate closed conduit or the flow allowed to reject freely into the atmosphere.

(b) The lower part or cage 40 of the above-mentioned universal reject-elutriator body 34 encloses nozzle 16; thus 34 and 40 are one piece. The wall of inlet 36, to opening 39 in nozzle 16, is curved such that as the nozzle is rotated, the wall of the nozzle approaches or recedes from said wall thereby allowing the outlet opening 36 to vary in size. Thus, by positioning the nozzle, the flow of rejects to the nozzle can be controlled by simply rotating the nozzle 16.

(c) Clamp 42, which clamps around the nozzle tube 41 and rests up against the bottom of cage 40, thereby prevents nozzle 16 from moving upwards under the influence of a vacuum effect which can take place on occasion at the outlet of sleeve 25.

It will be noted that the flow enters the chamber, is centrifugally throttled and then leaves the chamber. In a prior art method, the reject flow enters the chamber through one inlet in a direction which is at right angles to the central axis. Applicant has found that it is possible for the flow to enter inlets in a direction which is parallel to the central axis of the chamber. As was the case for the elutriation chamber, this axial direction allows for a more overall compact and efficient design with less chance of complete flow stoppage as well as a better balanced flow pattern.

Thus, it is seen that reject-centrifugal nozzle 16 and reject-elutriator 15 are contained in the universal overall reject enclosure or cage 34–40 which is joined to the universal collar 32 by clamp or retainer coupling 43. The enclosure may be made of conventional structural material (e.g. fiberglass, epoxy urethane formulations, steel, etc.).

A further feature referred to in the above is the manner in which the reject material stopped by the annular slit-like passage or opening 22 between the tip 28 (of sleeve 25) and surface 37 (of plate 35) can be reduced in size (as it orbits in the opening) until it is small enough to pass through the opening; this operation or process is effected by making surface 37 an abrasive surface (e.g. by use of ceramic materials). Thus, the opening can be used to control the size of material allowed to enter the reject unit and so reduce the risk of the centrifugal nozzle becoming plugged.

Looking at the above assembly of reject unit on an overall basis it will be seen to be a universal integrated rejects processing unit. For, once the rejects enter or are about to enter the unit they are submitted (a) to a size reduction process, (b) to an elutriation process (i.e. the accepts fraction washed out and returned to the main cleaner), (c) to a dilution process and (d) to a throttling process (which to a large degree is "plug-free"); and the degree to which each of the four processes are carried out can be regulated by (i) controlling the width of gap 22; (ii) the flow of elutriating liquid in through inlet 31; (iii) the degree of throttling by nozzle inlet 36 and (iv) the flow or flow pressure at the outlet and inlet to the main cleaner. The examination mentioned above in connection with the regulation of the elutriating liquid flow can also be used to regulate the other control points.

In addition, the unit is easily disassembled by merely removing one clamp and sliding the unit off the end of the conical portion of the main cleaner. This particular style of clamp is sold under the trade name "MARMON." It is possible also to join the lower part of rejects processing unit to the end grip or collar portion of the cone by a means other than the present style of clamp, e.g. by providing a screw-thread type connection.

As mentioned previously, the above processing unit can be modified so that the elutriating effect can be increased substantially and this was referred to as the "high-flow rejects elutriator." This can be done by increasing space 22 to 4 to 5 inches using one of the prior art design parts, i.e. elutriation water in greater quantities is introduced tangentially into a cylindrical shell-like container into a space shielded by an extension to the end of sleeve 25, the above universal reject assembly consisting of dimple plate and centrifugal nozzle is then moved down and attached to the bottom of the container. Thus, the advantages of the new reject assembly are combined with those of the old elutriating assembly to form a novel and more useful reject system.

Viewing the overall cleaner assembly it will be seen that a number of different sized main cleaner units, comprising headpiece 12, barrel-cone shell 24 and replaceable and adjustable sleeve 25, are adaptable to receive the above universal integrated rejects processing unit. This adaptability is achieved by using different sleeves having different thicknesses at the entrance to the reject processing unit. For example, a main unit having a 10-inch diameter barrel and a 400 U.S. GPM capacity could use a sleeve having a thickness of 0.625 inches at the entrance to the reject processing unit yielding a satisfactory rejects outlet of 2.250 inches in diameter; similarly, for an 8-inch barrel and a 175 U.S. GPM capacity the thickness could be 0.840 inches and the outlet 1.820 inches in diameter; for a 6-inch barrel and a 100 U.S. GPM capacity the thickness could be 1.075 and the outlet 1.350inches in diameter; yet in all these sizes the outside diameter of barrel-cone and sleeve would be the same at the point where the universal rejects processing unit combines with the main cleaner unit.

Thus it will be apparent from the above that applicant has provided an overall integrated method and apparatus for separating particles in such a way as to maximize the efficiency of the separation while at the same time minimizing manufacturing and maintenance costs.

The embodiments of the invention in which an exclusive property or privilege is claimed are defined as follows:

1. An apparatus for separating undesired particles from liquids and liquids and liquid suspensions, the apparatus comprising a chamber having a side wall disposed concentrically about a longitudinal axis, an inlet adjacent one end of said chamber for introducing a particle-laden fluid into said chamber and imparting a vortical flow thereto, a first discharge outlet in an end wall adjacent said first end, and a restricted outlet at the other end of said chamber, and a reject control and enclosure means concentric with and into which the restricted outlet at the other end of said chamber opens, the entrance to said enclosure being formed by an annular slit-like passage for discharge of rejected material, an annular enclosure surrounding said slit, the internal bottom surface of said enclosure being formed by a relatively blunt upright conical abrasive surface having an inverted conical area therein, the height of said slit-like passage being defined by the extension of said restricted lower end towards said surface such that the size of rejected material passing through said slit is controlled and the material held at the opening of said passage, while orbiting around said opening, is worn by said abrasive surface to a size which will allow the same to pass through said slit.

2. The apparatus of claim 1 wherein said chamber includes a lower portion of a frusto-conical configuration.

3. The apparatus of claim 2 wherein said abrasive surface is formed of a ceramic material.

4. The apparatus of claim 1 wherein the apparatus includes separate, removable lining means interiorly of and adjacent to said side wall to protect from erosion the inner surface of said chamber, said lining means having a configuration substantially similar to that of the chamber, whereby said lining means is adapted to fit into juxtaposition with said side wall of said chamber.

5. An apparatus as defined in claim 4, wherein there are included perforations in said wall to permit any liquid/gas formed in the interface between said lining means and said side lining means and said side wall to escape.

6. The apparatus of claim 4 wherein said lining means is formed of a urethane material.

7. The apparatus of claim 4 wherein said chamber includes a lower portion of a frusto-conical configuration.

8. The apparatus of claim 1 or 4 further including elutriating means at an outlet from said enclosure means to recover desired material from the rejected liquid.

9. The apparatus of claim 1 or 4 further including centrifugal throttling means at said outlet to reduce the fluid pressure of the rejected liquid, said throttling means being adapted to receive an inlet flow whose direction is parallel to the longitudinal axis of the chamber.

10. The apparatus of claim 1 or 4 wherein said chamber is perforated.

11. An apparatus for separating undesired particles from liquids and liquid suspensions, the apparatus comprising a side wall disposed concentrically about a longitudinal axis, an inlet adjacent one end of said chamber, a first discharge outlet in an end wall adjacent said first end, a restricted outlet at the other end of said chamber, an inlet adjacent said first end for receiving a particle-laden fluid and imparting a vortical flow thereto, a reject control and enclosure means concentric with and into which the restricted outlet at the other end of said chamber opens, the entrance to said enclosure being formed by an annular slit-like passage for discharge of rejected material, size control means proximate said restricted outlet comprising a relatively blunt upright conical abrasive surface having an inverted conical area therein, the height of said slit-like passage being defined by the extension of said restricted lower end towards said surface such that the size of rejected material passing through said slit is controlled and the material held at the opening of said passage, while orbiting around said opening, is worn by said abrasive surface to a size which will allow the same to pass through said slit, and centrifugal throttling means at the lower outlet to reduce the fluid pressure of the rejected fluid, said throttling means being adapted to receive an inlet flow whose direction is parallel to the longitudinal axis of the chamber.

12. The apparatus of claim 11 further including lining means on the inner surface of said side wall to protect the same from erosion.

13. The apparatus of claim 12 wherein a lower portion of said chamber has a frusto-conical configuration with the narrow end thereof providing said restricted outlet.

14. The apparatus of claim 12 wherein said side wall is perforated to permit any liquid/gas formed at the interface between said lining means and said side wall to escape.

* * * * *